US008002439B2

(12) United States Patent
Cavenati et al.

(10) Patent No.: US 8,002,439 B2
(45) Date of Patent: Aug. 23, 2011

(54) STAGE PROJECTOR

(75) Inventors: Angelo Cavenati, Brusaporto (IT); Pasquale Quadri, Torre de' Roveri (IT)

(73) Assignee: Clay Paky S.p.A., Seriate (IT)

( * ) Notice: Subject to any disclaimer, the term of this patent is extended or adjusted under 35 U.S.C. 154(b) by 103 days.

(21) Appl. No.: 12/282,379

(22) PCT Filed: Mar. 9, 2007

(86) PCT No.: PCT/IB2007/000554
§ 371 (c)(1),
(2), (4) Date: Jan. 28, 2009

(87) PCT Pub. No.: WO2007/122459
PCT Pub. Date: Nov. 1, 2007

(65) Prior Publication Data

US 2009/0303723 A1 Dec. 10, 2009

(30) Foreign Application Priority Data

Mar. 10, 2006 (IT) ..... MI2006A0436

(51) Int. Cl.
*F21S 8/00* (2006.01)
*F21V 5/00* (2006.01)

(52) U.S. Cl. ..... 362/268; 362/331; 362/277

(58) Field of Classification Search ..... 362/268, 362/331, 277, 282, 283, 284
See application file for complete search history.

(56) References Cited

U.S. PATENT DOCUMENTS

| | | | | |
|---|---|---|---|---|
| 2,344,263 | A * | 3/1944 | Perkins | 353/58 |
| 4,890,208 | A | 12/1989 | Izenour | |
| 6,092,914 | A * | 7/2000 | Esakoff et al. | 362/268 |
| 6,113,252 | A * | 9/2000 | Arlitt et al. | 362/365 |
| 6,817,737 | B2 * | 11/2004 | Romano et al. | 362/293 |
| 6,834,982 | B2 * | 12/2004 | Dedoro | 362/268 |
| 6,979,106 | B2 * | 12/2005 | de Peralta | 362/321 |
| 7,144,134 | B2 * | 12/2006 | Romano et al. | 362/293 |
| 2004/0125602 | A1 * | 7/2004 | Hunt et al. | 362/293 |
| 2005/0052872 | A1 | 3/2005 | de Peralta | |
| 2005/0068444 | A1 * | 3/2005 | Oshima et al. | 348/335 |
| 2010/0061107 | A1 * | 3/2010 | Jurik | 362/319 |

FOREIGN PATENT DOCUMENTS

EP 1 384 941 1/2004

* cited by examiner

*Primary Examiner* — Jong-Suk (James) Lee
*Assistant Examiner* — David R Crowe
(74) *Attorney, Agent, or Firm* — Ladas & Parry LLP

(57) ABSTRACT

A stage projector extends along a first axis and is provided with a first optical system having a first focus and designed substantially to generate and concentrate a light beam in the first focus, and a second optical system set downstream of the first focus and having a second focus, the second optical system having a first optical assembly, set in a given position along the first axis so that the second focus coincides with the first focus, and a second optical assembly, selectively mobile between an operative position, in which the second optical assembly intercepts the light beam between the first focus and the first optical assembly, and a position of rest, in which the second optical assembly does not intercept the light beam, the first and the second optical assemblies being mobile along the first axis in order to modify the form of the light beam and obtain a homogeneous distribution of the light within the light beam, when the second optical assembly is set in the operative position.

20 Claims, 3 Drawing Sheets

STAGE PROJECTOR

TECHNICAL FIELD

The present invention relates to a stage projector.

BACKGROUND ART

As is known, a stage projector extends along a first axis and comprises a first optical system, which has a first focus and is designed substantially to generate and concentrate a light beam in the first focus, and a second optical system set downstream of the first focus and having a second focus, the second optical system comprising a first optical assembly set in a given position along the first axis so that the second focus coincides with the first focus.

A stage projector of the type described above is referred to by the persons skilled in the sector as "wash projector" and is characterized in that it is particularly efficient in terms of brightness. Furthermore, the stage projector of the type described above is characterized in that the outgoing light beam has a cylindrical shape, is homogeneous, and can assume different colourings according to elements that may be inserted and that are selectively arranged in positions in which they intercept either totally or in part the light beam in the first optical system.

The shape and homogeneity of the light beam depend to a large extent upon the fact that the first focus substantially coincides with the second focus. This characteristic, however, presents particular disadvantages in so far as the second focus, i.e., the first optical assembly, must be kept in the given position. In the case where the first optical assembly were not to be kept in the given position, the first and second foci could not be kept in a position of substantial coincidence and the beam would lose in terms of homogeneity. This disadvantage is particularly evident when the light beam is coloured via the elements that may be inserted: when the first and the second foci do not coincide and the light beam is coloured, the light beam generates a spot (projection of light on a surface), which presents a coloured halo and a substantially white patch of light at the centre. Evidently, the need to keep the first and second foci coincident precludes the possibility of having a projector capable of producing a zoom effect.

On the other side documents EP 1,384,941 disclose US 2005/0052872 a stage projector extending along a first axis and comprising: a first optical system, which has a first focus (and is designed substantially to generate a light beam along the first axis and concentrate the light beam in the first focus; and a second optical system, set downstream of the first focus and having a second focus, said second optical system comprising a first optical assembly set in a given position along the first axis so that the second focus coincides with the first focus and a second optical assembly; the first and second optical assemblies being mobile along the first axis in order to modify the form of the light beam and obtain a homogeneous distribution of the light within the light beam.

However, the above "zoom" type projector cannot operate and have the same brightness of a "wash projector".

DISCLOSURE OF INVENTION

The aim of the present invention is to provide a stage projector of the type described above that on the one hand presents the characteristics of light efficiency and of constructional simplicity of the models of a "wash" type and that, at the same time, is able to overcome the drawbacks of the known art in a simple and inexpensive way.

According to the present invention, there is provided a stage projector extending along a first axis and comprising: a first optical system, which has a first focus and is designed substantially to generate a light beam along the first axis and concentrate the light beam in the first focus; and a second optical system, set downstream of the first focus and having a second focus, said second optical system comprising a first optical assembly set in a given position along the first axis so that the second focus coincides with the first focus and a second optical assembly; the first and second optical assemblies being mobile along the first axis in order to modify the form of the light beam and obtain a homogeneous distribution of the light within the light beam when the second optical assembly intercepts the light beam; the projector being characterized in that the second optical assembly is selectively mobile between an operative position, in which the second optical assembly intercepts the light beam and the first axis between the first focus and the first optical assembly so as to operate as a "wash" type projector, and a position of rest, in which the second optical assembly does not intercept the light beam and the first axis to operate as a zoom type projector.

Basically, the second optical assembly enables conversion in a simple and inexpensive way of a stage projector of a "wash" type into a stage projector provided with zoom, without this implying any loss in homogeneity of the light beam.

BRIEF DESCRIPTION OF THE DRAWINGS

For a better understanding of the invention, an embodiment thereof will be described hereinafter, purely by way of non-limiting example and with reference to the annexed plate of drawings, wherein.

BEST MODE FOR CARRYING OUT THE INVENTION

Figure 1:
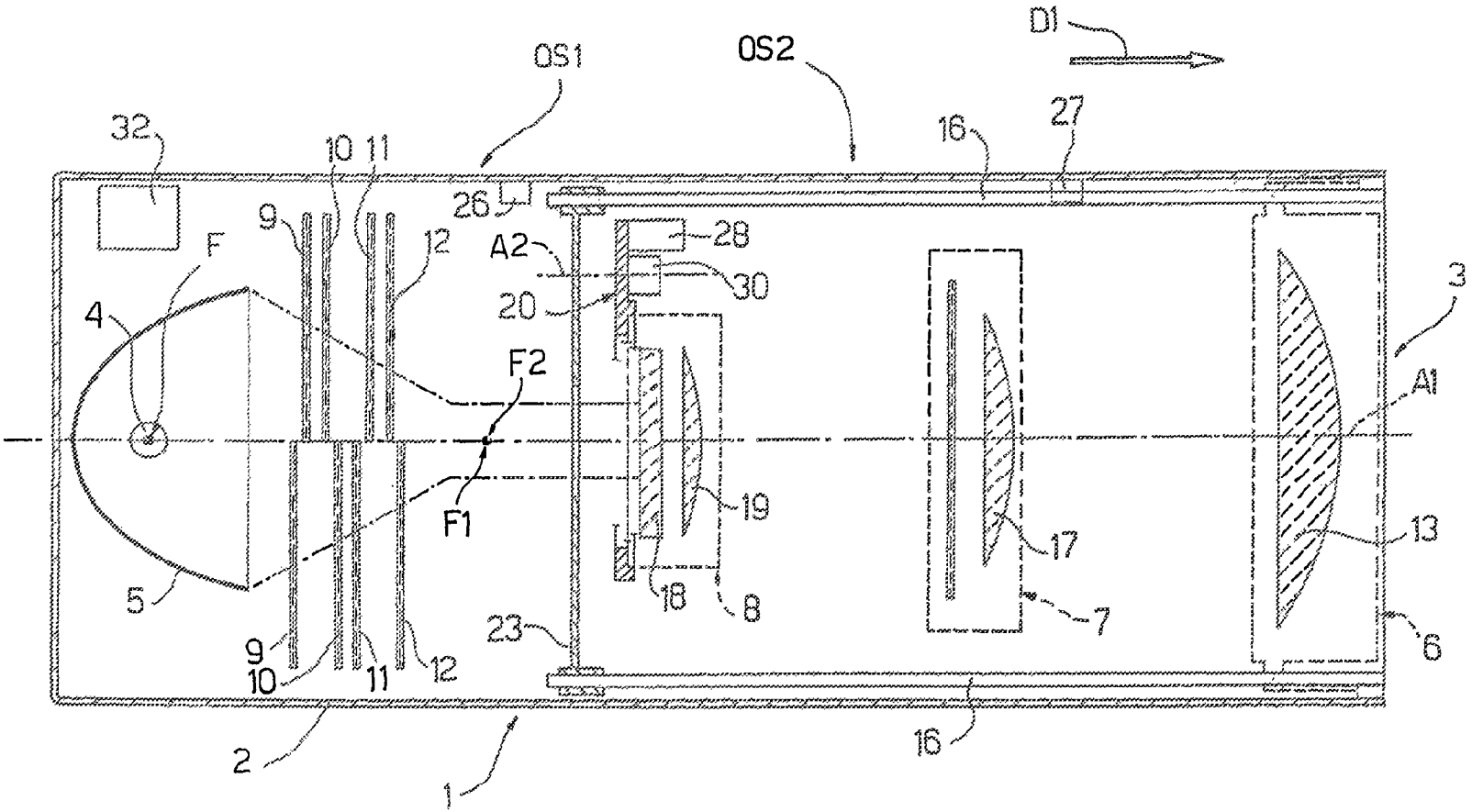
FIG. 1 is a schematic view, with parts removed for reasons of clarity, of a projector built according to the present invention in a first operative position.

With reference to FIG. 1, designated as a whole by 1 is a stage projector.

The projector 1 comprises a shell 2, which extends along an axis A1 and is provided with an outlet mouth 3. The projector 1 moreover comprises, within the shell 2 and in succession towards the outlet mouth 3, an optical system OS1, designed to generate and concentrate a light beam in a focus F1, and an optical system OS2, designed to intercept the light beam downstream of the focus F1 and obtain a light beam, which will exit from the mouth 3 and extend along the axis A1 in a direction D1 parallel to the axis A1. The optical system OS1 comprises a light source 4 and a mirror 5, which has a concave shape and is set around the light source 4. The mirror 5 is formed by a portion of ellipsoid, which has a focus F that coincides with the light source 4 and the focus F1 towards which the light beam generated by the light source substantially converges.

The optical system OS2 has a focus F2 that coincides with the focus F1 and comprises: an optical assembly 6 set in the proximity of the outlet mouth 3; an optical assembly 7 substantially having the function of diffusing filter; and an optical assembly 8, which is mounted in such a way that it can turn about an axis A2 parallel to the axis A1 so as to set the optical assembly 8 selectively in an operative position (indicated by dashed lines in FIG. 3), in which the optical assembly 8 is set along the axis A1 to intercept the light beam, and a position of rest (indicated by a solid line in FIG. 3), in which the optical assembly 8 does not intercept the light beam.

With reference to FIG. 1, the projector 1 comprises a set of insertable elements, which are of a known type and are designed to modify the characteristics of the light beam. This set of insertable elements is set between the mirror 5 and the focus F1 and comprises: a dimmer formed by a pair of motor-driven plates 9, designed to translate in a known way in a direction transverse to the axis A1 for intercepting the light beam selectively either totally or in part; a pair of mobile plates 10 of a light-blue colour; a pair of mobile plates 11 of a yellow colour; and a pair of mobile plates 12 of a magenta colour. All the insertable plates described above are controlled in the way described in relation to the plates 9, are common to stage projectors of a "wash" type, and are not described any further herein as regards their structure and movement because they are of a known type.

Figure 2:
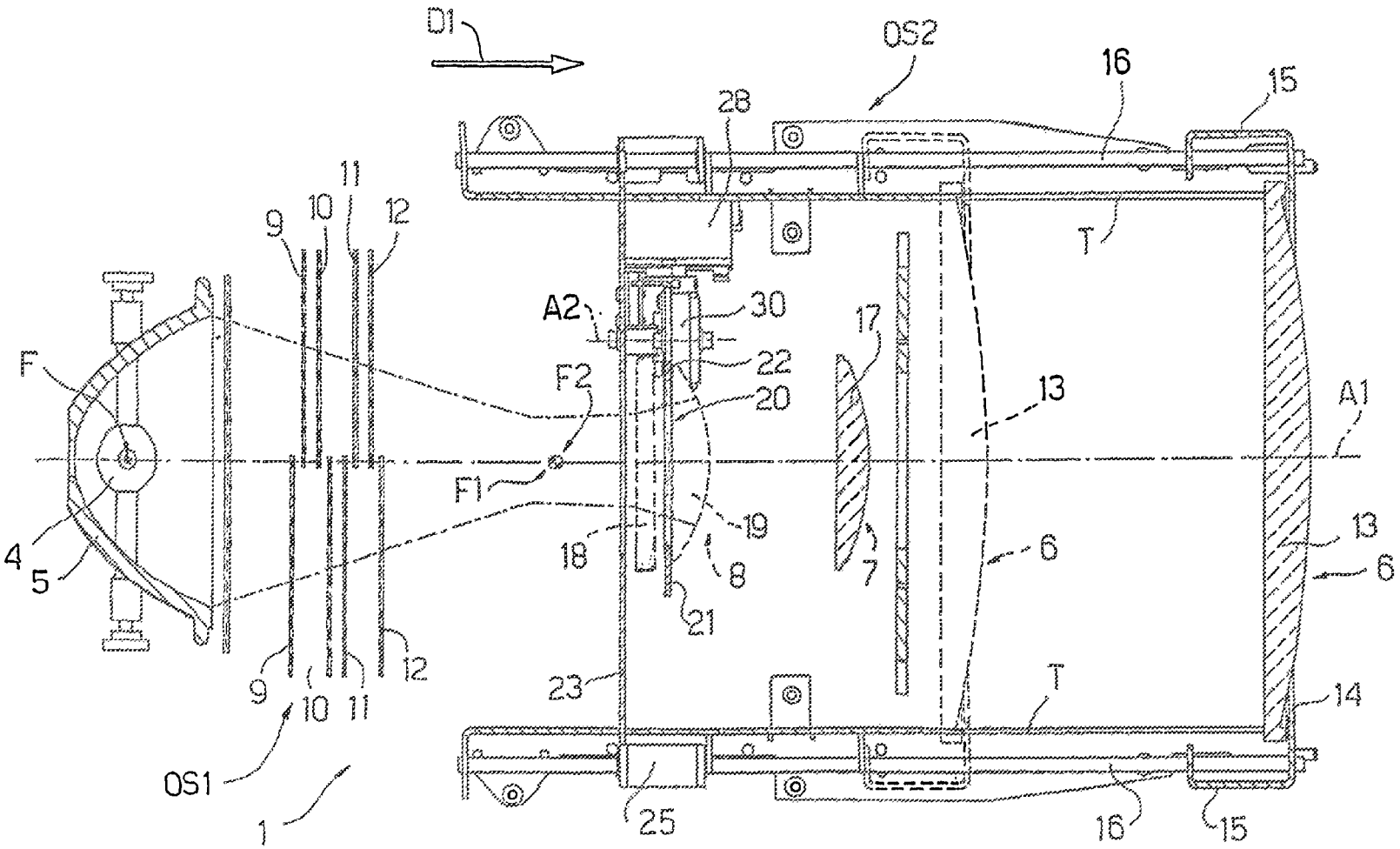
FIG. 2 is a side elevation, with parts removed for reasons of clarity, of the projector of FIG. 1.

In the case in point represented in FIG. 2, the optical assembly 6 comprises just one lens 13, which is, in particular, a Fresnel lens, it being understood that the optical assembly 8 can comprise other types of lens or sets of lenses. The lens 13 is fixed to a ring 14, which is in turn fixed to a pair of carriages 15 arranged on opposite sides of the axis A1. Each carriage 15 is engaged so that it can slide in a respective guide 16, which is parallel to the axis A1 and forms part of a supporting frame T of the projector 1.

The optical assembly 7 comprises a diffusing filter 17 and is fixed to the supporting frame T. The diffusing filter 17 can be replaced by other lenses having a similar function. However, the optical assembly 7 is optional.

With reference to FIG. 2, the optical assembly 8 comprises in succession, from left to right, a diffusing filter 18 and a plane-convex lens 19 and is mounted on an arm 20, which can turn about the axis A2. The mobile arm 20 comprises a ring 21 for supporting the optical assembly 8, and a plate 22, which is fixed with respect to the ring 21 and is mounted, in such a way that it can turn about the axis A2, on a perforated plate 23. The ring 21 and the plate 22 extend in a direction perpendicular to the axis A1. In the same way, the perforated plate 23 extends in a direction perpendicular to the axis A1 and moreover comprises an opening 24 (FIG. 3) to enable passage of the light beam. The plate 23 is fixed to two carriages 25, which are arranged on opposite sides with respect to the axis A1 and are engaged in the guides 16.

Basically, the optical assemblies 6 and 8 are both mobile along the axis A1, whilst the optical assembly 7 is fixed. Furthermore, the optical assembly 8 can turn about the axis A2 parallel to the axis A1.

In the configuration illustrated in FIG. 2, the optical assemblies 6 and 7 (indicated by a solid line) are arranged along the axis A1 so that the focus F2 coincides with the focus F1 when the optical assembly 8 is set in the position of rest. When the optical assembly 8 is set in the operative position indicated by dashed lines in FIG. 2, the position of the focus F2 does not change. When the optical assembly 6 is translated along the axis A1 in a direction opposite to the direction D1 until it reaches the position indicated by dashed lines in FIG. 2, the optical assembly 8 is translated in the direction D1 to keep the focus F2 coinciding with the focus F1.

Movement of the optical assemblies 6 and 8 is obtained in the way described in what follows. With reference to FIG. 1 and as regards the translation of the optical assembly 6, the projector 1 comprises an electric stepper motor 26 that controls drive pulleys (not illustrated), connected to the carriages 15 via belts (not illustrated) and wound around pulleys (not illustrated). Basically, the transmission of the motion between the electric motor 26 is a transmission of a known type and is consequently not illustrated in the attached figures.

In an altogether similar way, the translation of the optical assembly 8 is obtained via an electric stepper motor 27 that controls drive pulleys (not illustrated) connected to the carriages 25 via belts (not illustrated) and wound around pulleys (not illustrated).

Figure 3:
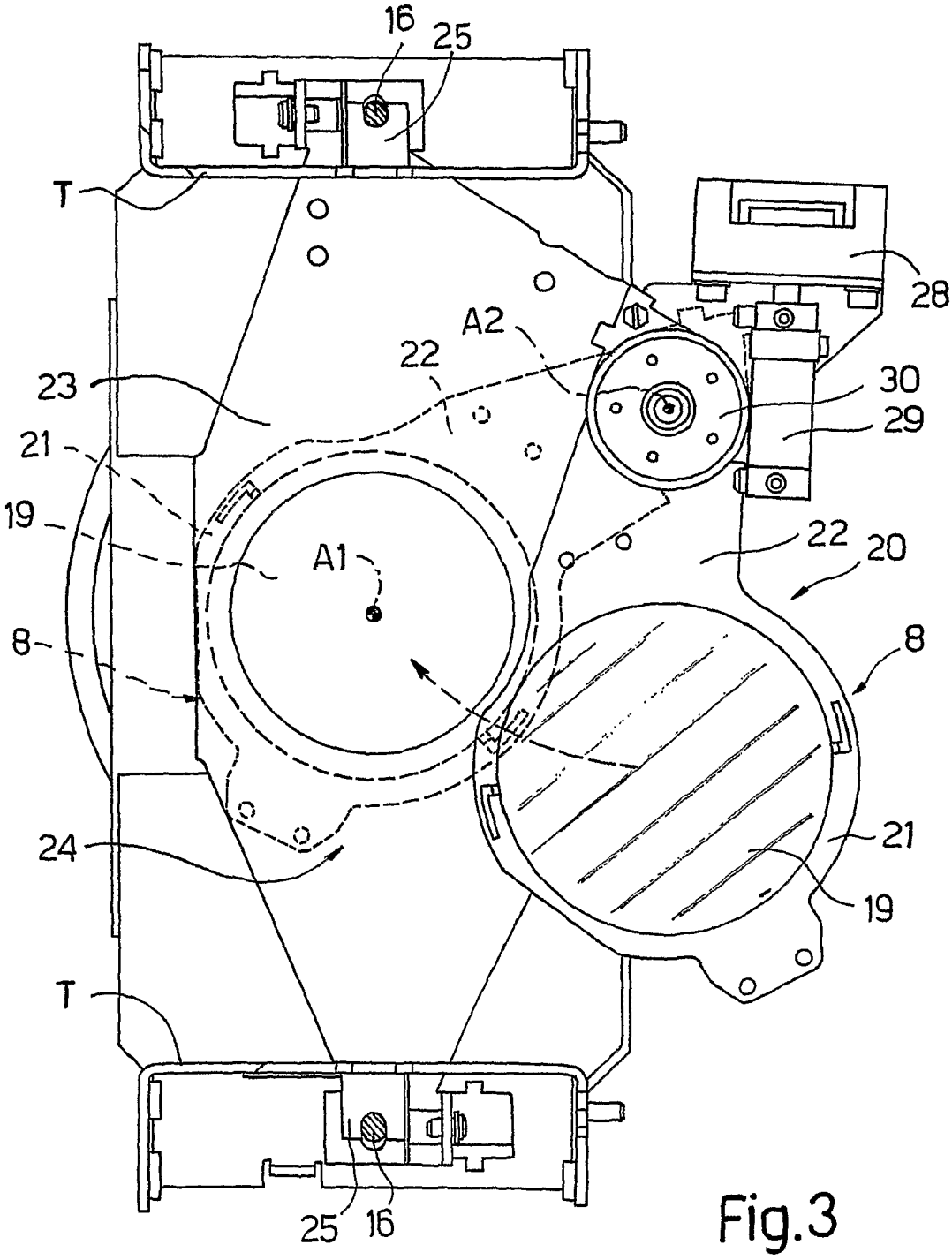
FIG. 3 is a front view, with parts in cross section and parts removed for reasons of clarity, of the stage projector built according to FIG. 2.

With reference to FIG. 3, rotation of the assembly 8 about the axis A2 is obtained via an electric stepper motor 28, which controls in rotation a wormscrew 29 engaging with a worm gear 30, which is fixed to the plate 22 and can turn about the axis A2.

With reference to FIG. 1, the projector 1 comprises a control unit 31, which co-ordinates the various functions and movements of the projector 1. In the case in point, management of the movement of the optical assemblies 6 and 8 is considered. For this purpose, the control unit 31 is connected to the electric motors 26, 27 and 28 and is configured so that the projector 1 will operate according to two operating modes: the first operating mode envisages that the optical assembly 8 will not intercept the light beam (projector with fixed focus and optical assembly 8 in position of rest); and the second operating mode envisages that the optical assembly 8 will intercept the light beam along the axis A1 and that the optical assemblies 6 and 8 will be able to translate along the axis A1, thus providing a zoom function (projector with zoom active and optical assembly in the operative position). In the first operating mode, the control unit 31 is configured so as to exclude any zoom function automatically, i.e., exclude the translation of the optical assemblies 6 and 8 along the axis A1. In addition to excluding the zoom function, the control unit 31 is configured so that, during passage from the second operating mode (projector with zoom active) to the first operating mode (projector with fixed focus), the optical assembly 6 will be set in the given position in the proximity of the outlet mouth 3 so as to obtain a substantial coincidence between the focus F1 and the focus F2.

The above arrangement prevents, during transition from the second operating mode to the first operating mode, projection of non-homogeneous light beams.

Furthermore, the unit 31 is configured in such a way as to calibrate displacement of the optical assembly 8 according to the displacement of the optical assembly 6 and keep the focus F2 coinciding with the focus F1 for any position assumed by the optical assembly 6 along the axis 1.

Particularly advantageous is the use of a wormscrew 29/worm gear 30 transmission for turning the optical assembly 8 about the axis A2. In fact, the wormscrew 29 and the gear 30 have a resistance to rotation when a rotary moment is applied to the gear 30. In this way, the weight of the optical assembly 8 is not able to turn the gear 30 and the wormscrew 29. This type of transmission enables avoidance of use of devices of arrest or engagement to keep the optical assembly 8 in the operative position.

The invention claimed is:

1. A stage projector extending along a first axis and comprising:

(a) a first optical system which has a first focus and is designed substantially to generate a light beam along the first axis and to concentrate the light beam in the first focus;

(b) a second optical system downstream of the first focus and having a second focus, said second optical system comprising a first optical assembly and a second optical assembly, the second optical assembly being movable between an operative position in which the second optical assembly intercepts the light beam and the first axis between the first focus and the first optical assembly and a rest position in which the second optical assembly does not intercept the light beam and the first axis;

wherein the first optical assembly is set at a position along the axis at which the second focus coincides with the first focus when the second optical system is in the rest position so as to provide the projector with a wash mode, and wherein the first optical assembly and the second optical assembly are translatable along the axis with respect to one another when the second optical assembly is in the operative position so as to provide the projector with a zoom mode wherein the first and second optical assemblies can be translated to cause the second focus to coincide with the first focus even with the first optical assembly at a position other than the set position.

2. The stage projector according to claim 1, comprising means for precluding translation of the first and second optical assemblies with the second optical assembly in the rest position.

3. The stage projector according to claim 1, comprising means for moving the first and second optical assemblies along the axis with the second optical assembly in the operative position.

4. A stage projector extending along a first axis and comprising: a first optical system, which has a first focus and is designed substantially to generate a light beam along the first axis and to concentrate the light beam in the first focus; and a second optical system, downstream of the first focus and having a second focus, said second optical system comprising (i) a first optical assembly that can be set in a position along the first axis wherein the second focus coincides with the first focus and (ii) a second optical assembly; the first and second optical assemblies being mobile along the first axis such that they can modify the form of the light beam and obtain a homogeneous distribution of the light within the light beam when the second optical assembly intercepts the light beam; wherein the second optical assembly is selectively mobile between an operative position, in which the second optical assembly intercepts the light beam and the first axis between the first focus and the first optical assembly whereby to provide the projector with a zoom mode, and a rest position, in which the second optical assembly does not intercept the light beam and the first axis whereby to provide the projector with a wash mode; and wherein the second optical assembly comprises a diffusing filter and a plane-convex lens, arranged so that the light beam intercepts in succession the diffusing filter and the plane-convex lens when the second optical assembly is in the operative position.

5. The projector according to claim 4, wherein the first optical system comprises a concave mirror and a light source set within the concave mirror.

6. The projector according to claim 5, wherein said mirror is a portion of an ellipsoid with the first focus and a further focus, the light source being set in a position coinciding with the further focus.

7. The projector according to claim 5, further comprising a plurality of elements, which intercept selectively either completely or in part the light beam between the light source and the first focus in order to modify the characteristics of the light beam.

8. The projector according to claim 4, wherein the second optical assembly is mobile along the first axis to compensate for the displacements of the first optical assembly and keep the second focus in a position substantial coinciding with the first focus.

9. The projector according to claim 4, wherein said second optical assembly is supported by an arm, which can turn about a second axis.

10. The projector according to claim 9, wherein the second axis is parallel to the first axis.

11. The projector according to claim 9, wherein said arm is coupled, in such a way that it can turn about the second axis, to a plate.

12. The projector according to claim 11, further comprising a first electric motor, fixed to the plate and coupled to the arm by means of a mechanical transmission for turning the arm about the second axis.

13. The projector according to claim 12, wherein said mechanical transmission comprises a wormscrew that can be actuated by the first electric motor and a worm gear, fixed with respect to the arm.

14. The projector according to claim 13, wherein said plate comprises two first carriages, which can slide along two respective guides parallel to the first axis.

15. The projector according to claim 4, wherein the first optical assembly is fixed to a ring fixed with respect to two second carriages, which can slide along two guides parallel to the first axis.

16. The projector according to claim 4, further comprising: a first electric motor for turning selectively the second optical assembly between the operative position and the rest position; a second electric motor for displacing the first optical assembly (6) along the first axis; and a third electric motor for displacing the second optical assembly along the first axis.

17. The projector according to claim 16, further comprising a control unit, designed to co-ordinate the first, second, and third electric motors.

18. The projector according to claim 17, wherein the control unit is configured in such a way as to exclude actuation of the second and third electric motors when the second optical assembly is set in the rest position.

19. The projector according to claim 17, wherein the control unit is configured so as to set the second optical assembly in the rest position only when the first optical assembly has been set in said position.

20. A stage projector extending along a first axis and comprising:

(a) a first optical system which has a first focus and is designed substantially to generate a light beam along the first axis and to concentrate the light beam in the first focus;

(b) a second optical system downstream of the first focus and having a second focus, said second optical system comprising a first optical assembly and a second optical assembly, the second optical assembly being movable between an operative position in which the second optical assembly intercepts the light beam and the first axis between the first focus and the first optical assembly and a rest position in which the second optical assembly does not intercept the light beam and the first axis;

wherein the first optical assembly can be set at a position along the axis at which the second focus coincides with the first focus when the second optical assembly is in the rest position so as to provide the projector with a wash mode, and wherein the first optical assembly and the second optical assembly are translatable along the axis with respect to one another when the second optical assembly is in the operative position so as to provide the projector with a zoom mode wherein the first and second optical assemblies can be translated to cause the second focus to coincide with the first focus even with the first optical assembly at a position other than the set position;

(c) a first electric motor for selectively moving the second optical assembly between the operative position and the rest position;

(d) a second electric motor for displacing the first optical assembly along the first axis;

(e) a third electric motor for displacing the second optical assembly along the first axis; and (f) a control unit to co-ordinate the first, second, and third electric motors so as to exclude actuation of the second and third electric motors when the second optical assembly is set in the rest position and to set the second optical assembly in the rest position only when the first optical assembly has been disposed in said set position.

* * * * *